United States Patent [19]

Krasin

[11] 4,061,911

[45] Dec. 6, 1977

[54] AUTOMATICALLY SWITCHED SPARE LAMP FOR A LIGHT PROJECTOR

[75] Inventor: Thomas L. Krasin, Darien, Ill.

[73] Assignee: Audio Visual Innovators Corporation, Darien, Ill.

[21] Appl. No.: 676,746

[22] Filed: Apr. 14, 1976

[51] Int. Cl.[2] ..... H05B 39/10

[52] U.S. Cl. ..... 362/20; 315/88; 352/198; 353/85

[58] Field of Search ..... 240/37.1, 41.25, 44.1, 240/41.35 A, 41.35 B; 352/198; 353/85; 315/88

[56] References Cited

U.S. PATENT DOCUMENTS

| | | | |
|---|---|---|---|
| 1,896,768 | 2/1933 | Chubb | 240/37.1 |
| 3,269,795 | 8/1966 | Floden | 352/198 |
| 3,577,173 | 5/1971 | Blomgren | 240/37.1 |
| 3,914,645 | 10/1975 | LiDonnici | 240/37.1 |

FOREIGN PATENT DOCUMENTS

| | | | |
|---|---|---|---|
| 2,300,705 | 7/1974 | Germany | 353/85 |

*Primary Examiner*—R. N. Envall, Jr.
*Attorney, Agent, or Firm*—McWilliams & Mann

[57] ABSTRACT

A lamp system for a light projector for continuous light projection upon burn-out of a main lamp. A main lamp with a highly directional light pattern is mounted to the frame for light pattern alignment with the optical axis of the projection lens. A spare lamp is mounted at a location remote from the optical axis. Electronic circuitry detects failure of the main lamp and energizes the spare lamp. A mirror pivots about a point remote from the optical axis for positioning the mirror between the first position which does not effect nor obstruct light transmission between the main lamp and the projection lens and between a second position where the mirror reflects light from the automatically energized spare lamp along the optical axis of the projection lens upon failure of the main lamp. A pivotable lever holds the mirror in the first position before failure of the main lamp, and an electromechanical device, controlled by the circuitry, releases the lever and permits a spring to urge the mirror toward the second position. A mirror with a resilient portion stops the mirror in the second position in a vibration-free manner. A switch senses the position of the mirror to turn-on the spare lamp as the mirror is assuming the second position for substantially uninterrupted light projection.

10 Claims, 3 Drawing Figures

AUTOMATICALLY SWITCHED SPARE LAMP FOR A LIGHT PROJECTOR

BACKGROUND OF THE INVENTION

This invention relates in general to a lamp system for a light projector, and more particularily to a lamp system wherein a main lamp is fixedly located on an optical axis of the projection lens for transmitting full brilliancy thereof and a spare lamp is fixedly located in a location not in alignment with the optical axis and reflecting means are positionable between first and second positions wherein light transmission of the main lamp is not obstructed in the first position, and sensing means, actuating means, and releasing means allow the reflecting means to assume a second position for reflecting light from the spare lamp along the optical axis after failure of the main lamp.

Various types of lamp changing mechanisms for light projectors are known to the prior art. Most of such mechanisms generally employ a sliding or rotating carriage, with a main lamp and a spare lamp mounted thereon, for physically moving the spare lamp into the position formerly occupied by the main lamp upon burn-out thereof. The combined mass of such mechanisms inherently gains sufficient inertia during the transition between the main lamp and the spare lamp such that considerable vibration is experienced in the projector when the spare lamp is stopped in the desired position. Because projectors are usually located a considerable distance from the screen or other surface upon which light is projected, even slight movement of the projector caused by vibration translates into much greater movement of the projected image on the screen, and may even result in a portion of the image being located off of the screen. In commercial applications, where images from more than one projector are superimposed or where dissolving between images is required, even slight movement of the projectors becomes intolerable.

Some prior art projectors also suffer from ineffecient light transmission from the main lamp because reflecting means are used therewith. Light transmission losses of about 15 to 20% are customary when reflecting means are used, due to light scattering, reflection losses and imperfect alignment or adjustment of the reflecting surface.

SUMMARY OF THE INVENTION

The lamp system of the present invention is utilized in a projector having a frame and at least one projection lens with an optical axis associated therewith. A main lamp with a highly directional light pattern is fixedly mounted in relationship to the frame of the projector at a point in alignment with the optical axis of the projection lens, thereby providing highly effecient light transmission between the main lamp and the projection lens. A spare lamp with a highly directional light pattern is also fixedly mounted in relationship to the frame of the projector, but is at a location not in alignment with the optical axis.

Reflecting means of low mass is positionable between a first position where the reflecting means does not obstruct light transmission between the main lamp and the projection lens, and at a second position where the reflecting means reflects light from the spare lamp along the optical axis of the projection lens. Sensing means detects failure of the main lamp and thereupon energizes the spare lamp. The lamp system further preferably includes releasable securing means for holding the reflecting means in the first position thereof before failure of the main lamp and actuating means for releasing the securing means upon failure of the main lamp thereby permitting the reflecting means to assume the second position for reflection of light from the spare lamp.

The reflecting means is pivotally connected in relationship to the frame of the projector such that is pivots between the first and second position thereof. Resilient means urge the reflecting means from the first position to the second position when the reflecting means are released by the securing means. Stop means, with a shock absorbing portion for contacting the reflecting means, limits the pivoting movement of the reflecting means when the reflecting means has assumed the second position. The resilient means continue to urge the reflecting means against the stop means after the reflecting means have assumed the second position, thereby keeping the reflecting means in the second position, with the stop means providing an essentially vibration-free movement of the reflecting means to the second position.

The lamp system further utilizes switch means for sensing the positions of the reflecting means. The switch means, with a pair of contacts electrically connected to the main lamp and to the spare lamp, disconnect the main lamp and electrically connect the spare lamp in response to said sensing means. The switch means electrically connects the spare lamp to the voltage source as the reflecting means begins to leave the first position thereof, thereby allowing the spare lamp to immediately energize and begin increasing in illumination intensity as reflecting means begin assuming the second position thereof, thereby providing substantially uninterrupted light upon failure of the main lamp.

Various other objects, features and advantages of the invention will become apparent from the following detailed disclosure when taken in conjunction with the drawings.

DESCRIPTION OF THE PREFERRED EMBODIMENTS

Figure 1:
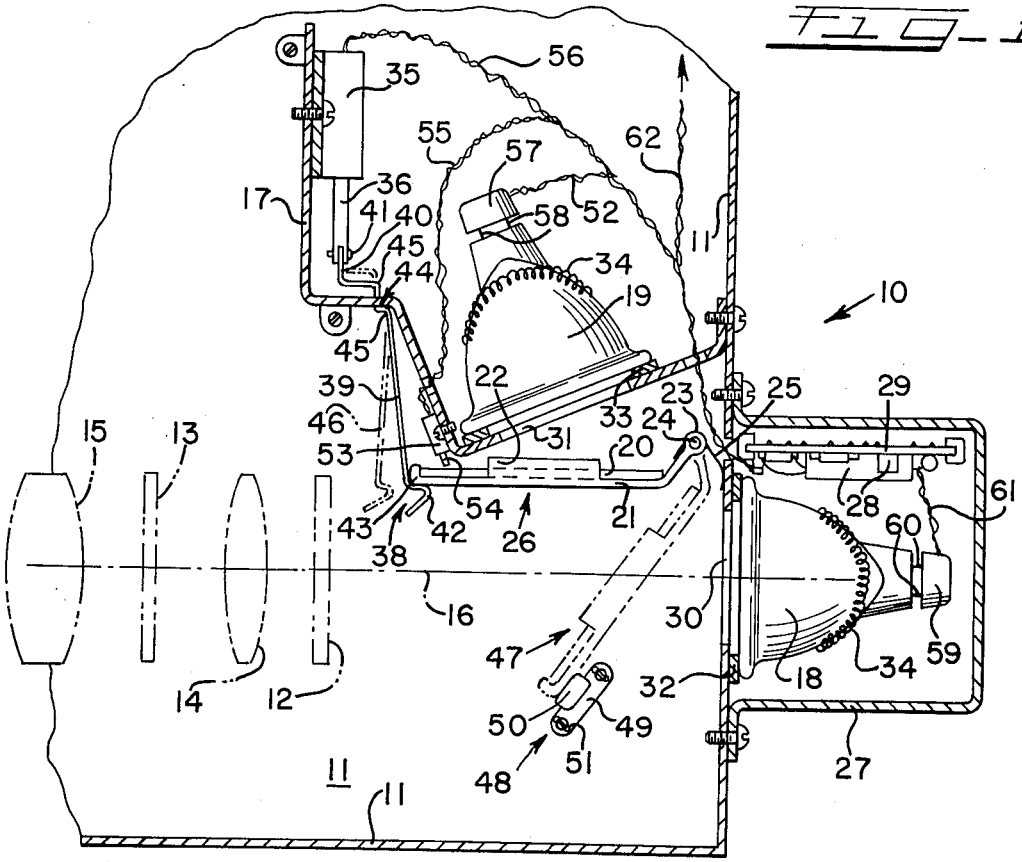
FIG. 1 is a plan view, partially in section, of the interior of a portion of a light projection system illustrating the lamp and optical arrangement of the invention.

Turning to FIG. 1, there is shown a portion of the interior of a light projection system in plan view. FIG. 1 is partly in section and illustrates a light projection system, generally designated 10, which is particularly useful in a slide projector.

Many other components, beside those illustrated in FIG. 1, are employed in a typical light projection system used in a slide projector. Such components include a motor for ventilating heat from the interior of the projector and actuating means for a slide changing mechanism. However these additional components are not necessary for an appreciation and understanding of the invention herein.

The projector, generally designated 10, of FIG. 1 has a frame 11 suitable for securing various internal components thereto. A heat absorbing glass 12 is usually located on the lamp side of a slide 13. A condensing lens 14 is interposed between the slide 13 and the heat absorbing glass 12 and condenses illumination from a light source. A focusing lens 15 is located on the opposite side of the slide 13 and is usually movable through a limited distance for focusing the image presented by the illuminated slide upon a screen (not shown) or the like. A common optical axis 16 is shared by the focusing lens 15 and the condensing lens 14.

A web 17 generally meanders through the interior of the projector thereby subdividing the interior of the projector 10 into various compartments. These various compartments are usually designed for best light transmission, heat ventilation and the like. Such considerations are beyond the scope of this invention. However the web 17 is useful for mounting various components required by the invention.

According to one aspect of the invention, there is provided a main lamp 18 fixedly mounted with respect to the frame 11 on the optical axis 16 of the lenses 14, 15. Also fixedly mounted with respect to the frame 11, at a position off of the optical axis 16, is a spare lamp 19. As shown in FIG. 1, the spare lamp 19 is at oblique angle with respect to the optical axis 16. Both of the lamps 18, 19 preferably have highly directional light patterns for optimum light transmitting efficiency. A reflecting mirror 20 is positionable between two positions as illustrated in FIG. 1. In the first position, shown in dark lines and generally designated 26, the mirror does not obstruct light transmission between the main lamp and the projection lenses 14, 15. In the second position, shown in the lighter lines in FIG. 1 and generally designated 47, the mirror is in position to reflect light from the spare lamp 19 along the optical axis 16 of the projection lenses 14, 15. A mirror holder 21 supports the mirror 20 and pivots the mirror 20 between its first and second positions 26, 47, respectively. The mirror holder 21 has tabs 22 at the top and bottom edges thereof bent or rolled through 180° to define a channel in which the mirror 20 is secured. One vertical edge 23 of the mirror support 21 is pivotally secured with respect to the frame 11. One means of accomplishing the pivoting relationship is to have the horizontal edge 23 bent to define a cylindrical aperture therealong. A post 24 fixedly attached with respect to the frame pivotally secures the end 23 of the mirror support 21 to the frame 11. The post 24 is located away from the optical axis 16 such that light from the main lamp 18 is not obstructed. Resilient biasing means 25, resiliently biases the mirror 20 from the first position thereof to the second position thereof. The biasing means 25 is typically a coil spring wrapped about the post 24, with one end of the means 25 cooperating with the frame 11 to urge the mirror 20 and the mirror support 21 toward the second position 47 thereof.

To enable both of the lamps 18, 19 to be located the same optical distance from the condensing lens 14, the main lamp 18 is preferably located within a housing 27 fixedly attached to the rear of the projector 10. It is understood that the front of the projector 10 is commonly the side of the projector 10 nearest to the focusing lens 15. Also located within the housing 27 is sensing means for detecting the failure of the main lamp 18. The sensing means consist of a number of electrical circuit elements 28 mounted on a circuit board 29, with the circuit board 29 fixedly secured within the housing 27.

The lamps 18, 19 are a high brilliancy type which generally have a relatively short life-span. These lamps 18, 19 have self-contained reflectors for providing light with a highly directional light pattern.

To facilitate light transmission from the main lamp 18 along the optical axis 16, a window area 30 is provided in the frame 11 about the axis 16. Another window area 31 is provided in the web 17 to allow light transmission from the spare lamp 19. Between the main lamp 18 and the frame 11 may be interposed a shock absorbing material 32. The material 32 is generally a gasket capable of withstanding high temperatures at which the main lamp 18 will operate. Shock absorbing material 33, similar to that of the material 32, may be interposed between the spare lamp and the web 17. Both of the lamps 18, 19 are secured against the shock absorbing material 32, 33 by resilient means 34. Examples of the resilient means 34 include elongated coil springs or wires which exhibit spring tension.

An electromechanical device 35, with a plunger 36 movable with respect to the device 35, is fixed in relation to the frame 11 and is preferably affixed to the web 17. The plunger 36 operates releasable securing means, generally designated 38, for the mirror holder 21, permitting the mirror 20 to assume its second position 47 when resiliently biased thereto. The electromechanical device 35 and the plunger 36 comprise the actuation means for the releasable securing means 38. The releasable securing means 38 typically comprises a lever 39 with one end 40 thereof secured to an end 41 of the plunger 36. Another end 42 of the lever 39 is hook-shaped to engage another vertical edge 43 of the mirror support 21 in the first position 26 thereof. Intermediate the ends 40, 42 of the lever 39 is a point 44 of the lever. The point 44 is attached to the web 17 in a fulcrum or pivotable fashion. One means of achieving the fulcrum or pivotable relation between the lever 39 and the web 17 is to have the lever 39 pass through an aperture in a web 17, with the lever 39 having the series of bends 45 near the point 44 such that the lever 39 cannot move about its length with respect to the web 17 but can only pivot with respect to the web 17 at the point 44. When the electromechanical device 35 is energized, causing the plunger 36 to move into the device 35, the lever 39 will assume the dotted position 46 thereof, thereby releasing the mirror support 21 and the mirror to assume the second position 47 thereof.

A mirror stop means 48 is fixedly attached in relationship to the frame 11 and is located to limit movement of the mirror support 21 to the second position 47 thereof. The mirror stop means 48 has a base plate 49 attached to the frame 11 with a shock absorbing portion 50 projecting upwardly from the base plate 49. The shock absorbing portion 50 stops the mirror support 21 upon reaching the second position thereof in an essentially vibration-free manner. The base plate 49 of the stop means 48 may employ slots 51 therein to permit adjustment of the mirror stop means 48 to permit fine adjustment of the reflected light from the spare lamp 19 along the optical axis 16.

A switch 53 is fixedly mounted to the web 17 at a location near the first position of the mirror 20. A pin 54 projects from the switch 53 for sensing whether the mirror 20 is in the first position 26 thereof, with the mirror 20 urging the pin 54 into the switch 53. The switch 53 is electrically connected to the circuit board 29, the main lamp 18 and the spare lamp 19 by a plurality of leads 55 in a manner which will be hereinafter explained.

It will be appreciated that the electromechanical device 35 controls the state of switch 53 because of the mechanical interconnection from the plunger 36, to the releasable securing means 38, to the mirror support 21, to the mirror 20, and finally to the pin 54 of the switch 53. When the the main lamp 18 fails and the current sensing means energizes the electromechanical device 35 causing the mirror securing means 38 to assume the second position 46 thereof, the pin 54 of the switch 53 will be released as the mirror 20 begins to move toward its second position 47, thereby switching the state of the switch 53 as the mirror 20 begins to leave the first position 26 thereof. Thus the spare lamp 19 is immediately energized and the spare lamp 19 begins to increase in illumination intensity toward full brilliancy as the mirror 20 assumes the second position 47 thereof. Because the transition of the mirror 20 from its first position 26 to its second position 47 requires only a fraction of a second and the spare lamp 19 is increasing in illumination intensity during this period, light projection along the optical axis 16 is substantially uninterrupted by failure of the main lamp 18. The main lamp 18 does not stop providing light exactly at the instant in which failure thereof occurs, but continues providing light in decreasing intensity as the filament thereof cools toward lower temperatures. Thus, light overlap between the burned-out main lamp 18 and the newly energized spare lamp 19 further aid in continuity of projected light.

Figure 3:
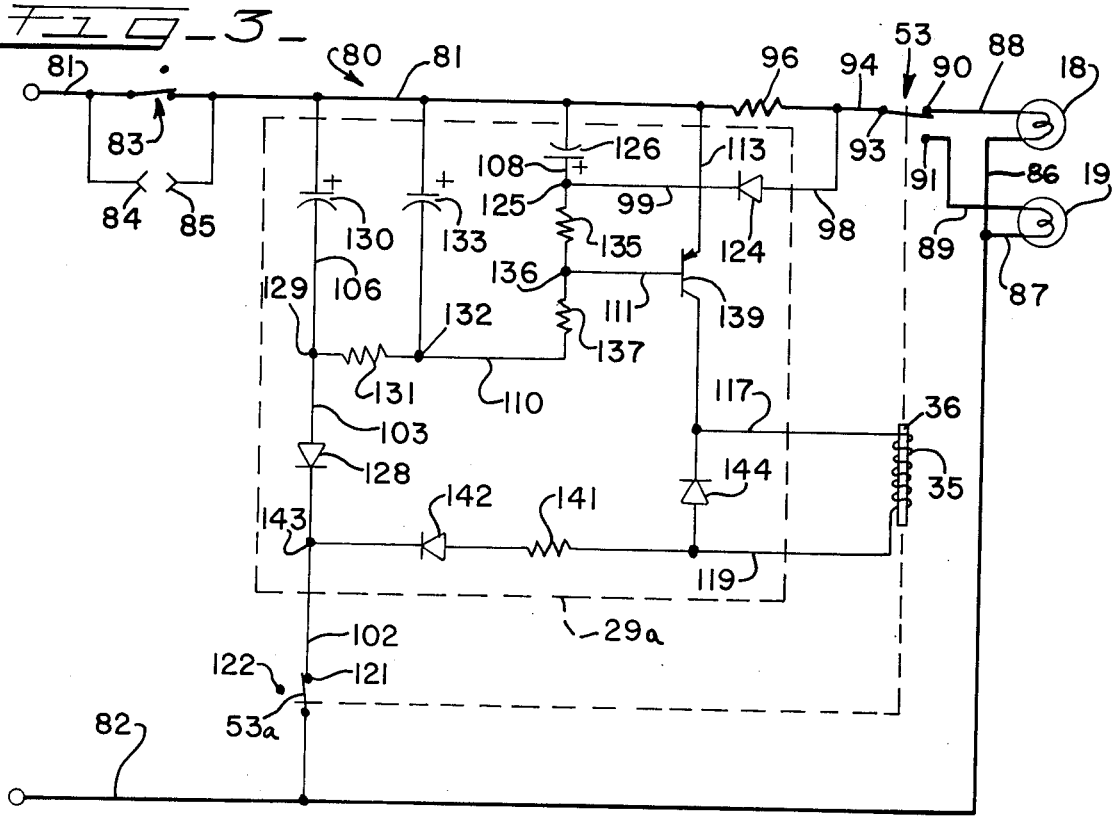
FIG. 3 is a schematic diagram of the control circuit for sensing the failure of the main lamp and automatically switching to the spare lamp of the projection system.
Figure 2:
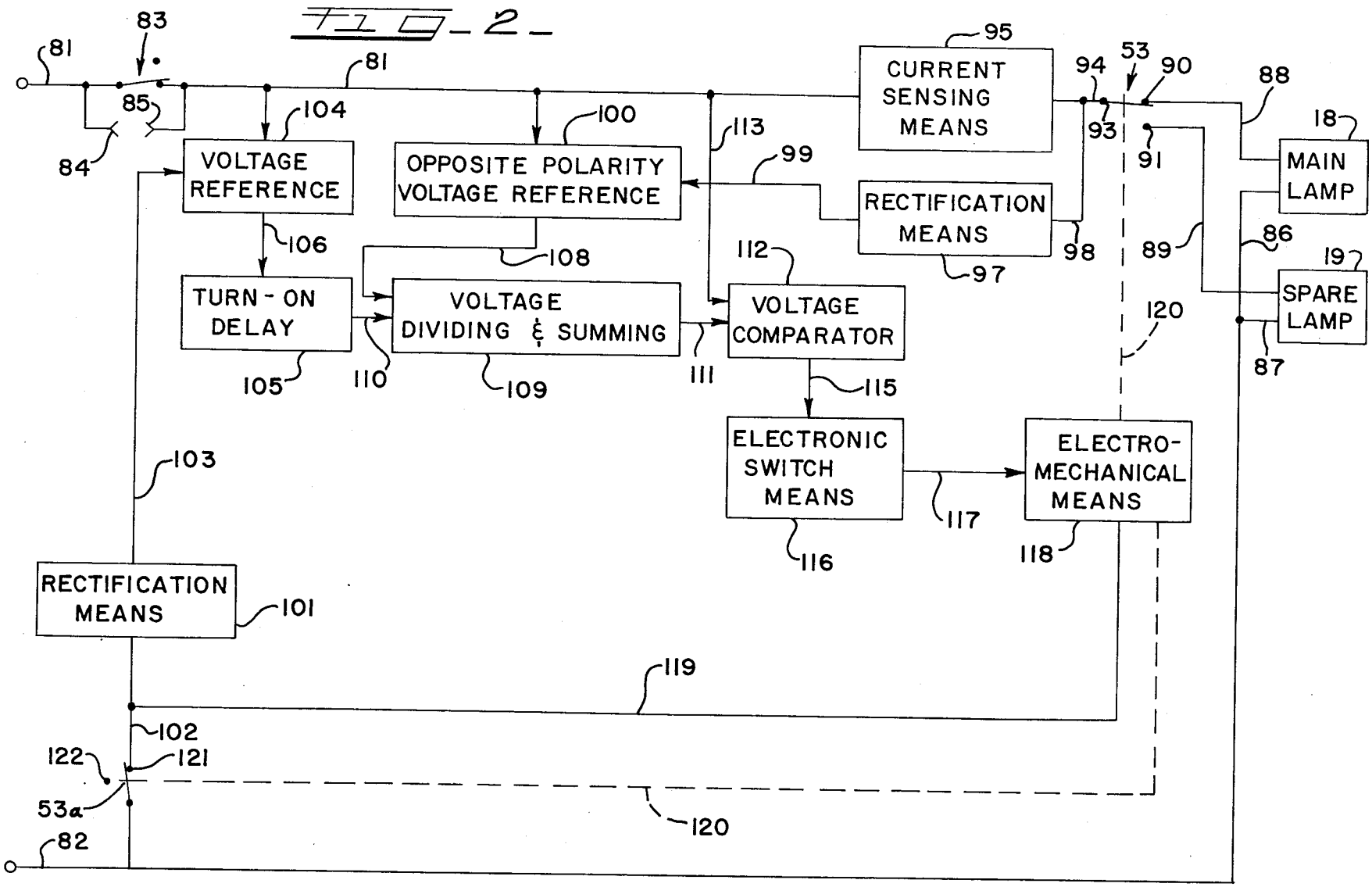
FIG. 2 is a block diagram of the control circuit of the invention, functionally illustrating the operation thereof.

Various other electrical interconnections are made in FIG. 1. A pair of leads 56 connect the electromechanical device 35 through the circuit board 29. Electrical connection between the spare lamp 19 and the circuit board 29 is accomplished by means of a socket 57 connecting to a pair of leads 58 of the spare lamp 19, with a pair of wires 52 interconnecting the socket 57 with the circuit board 29. Similarily, a socket 59 connects to the leads 60 of the main lamp 18, with a pair of wires 61 electrically connecting the socket 59 to the circuit board 29. A plurality of other leads 62 electrically connect the lamps 18, 19, circuit board 29, switch 53 and electromechanical device to the alternating-current voltage source, power switch 83 and a current sensing resistor 96. The need for leads 62 and their significance will become apparent when FIGS. 2 and 3 are considered hereinafter.

The above description of the lamp system has been on a piecemeal basis. It is now appropriate to consider the overall function and advantages of the lamp system. Both the main lamp 18 and the spare lamp 19 are preferably located at approximately equal optical distances from the condensing lens 14. A typical optical distance would be about 9 centimeters. The main lamp 18 is located directly in line with the optical axis 16 for maximum light transmission. It is known to those skilled in the art that use of any reflecting device results in about 15 to 20% of light loss due to light scattering, reflecting losses, improper adjustment of the reflecting device and the like. However after failure of the main lamp, such losses can be tolerated with respect to spare lamp 10 until nonuse of the projection system allows sufficient time for replacement of the main lamp 18. When the projector 10 is partially disassembled for replacement of the burned-out main lamp 18, the mirror 20 is manually reset into the first position 26 by pushing it from the second position 47 back into the first position 26. The hook-shaped end 42 of the securing means 38 engages the vertical edge 43 of the mirror support 21 to retain the mirror 20 in the first position 26. As will be hereinafter explained, the electromechanical device 35 moves the securing means 38 to the releasing positions 46 for only a brief interval after failure of the main lamp 18. Thus, the securing means 38 is able to again retain the mirror in the first position 26 whenever it is convenient to replace the main lamp 18 and manually reset the mirror 20.

It is important that the reflecting mirror 20 and the associated mirror support 21 are located in a position off of the axis 16 such that light from the main lamp 18 is not obstructed in any manner during operation of the main lamp 18. Also the mirror 20 must pivot from its first position 26 to its second position 47 at a point remote from the axis 16 such that light transmission from the main lamp 18 is not interferred with. The mirror support 21 is preferably fabricated from material with low mass properties, such as aluminum. Mirror 20 is preferably as thin as possible to keep the mass thereof at a minimum. Preferably, the combined mass of the mirror 20 and the support 21 is less than 3 ounces. The low masses of the mirror 20 and the mirror support 21 further aid in keeping vibration caused by transition of the mirror 20 and the support 21 from the first position 26 to the second position 47 at a minimum. Because the projector 10 is typically located some distance from the screen upon which the enlarged image of the slide 13 is projected, any small movement of the projector 10 about the optical axis 16 translates into a sizeable displacement of the enlarged image on the screen. Such displacement is particularily undesirable in presentations before large audiences where the images of a plurality of projectors are superimposed on the screen and where a portion of the projected image is off of the screen.

Slide projectors which are suitable for practicing the invention taught herein are commercially available from the Eastman Kodak Company of Rochester, New york and are identified by that Company as Ektagraphic Models B-2 and E-2.

A control circuit, generally designated 80, for detecting the failure of the main lamp 18 is illustrated in FIG. 3. To better facilitate understanding of the operation of the circuit 80, a block diagram of the circuit is illustrated in FIG. 2.

With reference to FIG. 2 there are provided a pair of input lines, including a line 81 and a line 82, for applying an alternating-current voltage source to the circuit 80. A manually-operated power switch 83 is operable between on and off positions to control application of the voltage source to the circuit 80. The switch 83 is usually provided with most projectors by the manufacturers thereof. in addition, most projectors suitable for commercial purposes include a pair of jacks 84, 85 in electrically parallel connection with the switch 83. The jacks 84, 85 provide capability to control the main lamp 18 or the spare lamp 19 from a remote source. Remote source controls could include dimming devices to control the illumination intensity of the main lamp 18 or the spare lamp 19, such as when dissolving from the image provided from one projector to the image provided by another projector. In more sophisticated applications the jacks 84, 85 enable control of a plurality of projectors by programmable computers for automated and creative presentations.

The main lamp 18 and the spare lamp 19 are wired in substantially parallel connection. A lead 86 from the main lamp 18 and a lead 87 from the spare lamp 19 are connected to the input line 82. A lead 88 from the main lamp 18 and a lead 89 from the spare lamp 19 are connected to contacts 90, 91, respectively, of the switch 53. As previously discussed, the switch 53 is usually held closed relative to the contact 90 when the mirror 20 is in the first position 26 thereof, as illustrated by the dark lines in FIG. 1. The switch 53 will open from contact 90 and close with respect to contact 91 as the mirror 20 is released from its first position 26.

Another terminal 93 (FIG. 2) of the switch 53 is connected by a lead 94 to the current sensing means 95 for the main lamp 18. The current sensing means 95 is in series between one of the input lines 81 and the lead 94. Typically the current sensing means comprises a resistor 96 (FIG. 3) of low ohmic value. The current sensing resistor 96 is found in many projectors, not employing the invention herein, to limit the inrush current to the main lamp 18 when the voltage source is first applied thereto by closing the power switch 83. The resistor 96 also functions to drop a small portion of the input voltage source thereacross, as compared to the voltage dropped by the main lamp 18 or the spare lamp 19, thereby operating the lamp 18 or the spare lamp 19, at a slighty reduced voltage from that of its nominal voltage rating. Operation of such lamps at a slightly reduced voltage level is known to prolong their operative life span.

With the basic wiring of a projector employing a spare lamp 19 in mind, fundamental operation of the circuit 80 may be understood by considering the block diagram of FIG. 2. According to another aspect of the invention, rectification means 97 is connected by a lead 98 to the lead 95 for rectifying the small portion of the alternating-curent voltage source dropped across the current sensing means 95. A lead 99 from the rectification means 97 establishes a voltage reference 100 between the lead 99 and the input line 81. A second rectification means 101 rectifies the voltage appearing across the input lines 81, 82 to establish a second voltage reference 104 which is opposite in polarity with respect to the input line 81 to the voltage reference 100. The second rectification means 101 is connected by lead 102 through a second switch **53*a* to the input line 82, and by lead 103 to the second voltage reference 104. Because the rectification means 97, 101 rectify alternating-current voltages, the first voltage reference 100 and the second voltage reference 104 are both direct-current potentials. Furthermore, these potentials are both referenced to the input line 81 and float with respect thereto despite any alternating-current voltage variation in the line 81**.

The second voltage reference 104 is presented to a turn-on delay 105 through a lead 106. Both the first voltage reference 100 and an output of the turn-on delay 105 are presented to a voltage summing and dividing means 109 by a lead 108 and a lead 110, respectively. The voltage summing and dividing means 109 sum and proportion the potentials of the voltage references 100, 104 on the leads 108, 110 to provide a tracking voltage reference at an output lead 111 of the voltage summing and dividing means 109. As long as both the first voltage reference 100 and the second voltage reference 104 are operative, the tracking voltage reference appearing on the lead 111 will be approximately equal in potential to the potential appearing on the input lead 81. A voltage comparator 112 compares the potential of the tracking voltage reference on the lead 111 to the potential on the input line 81. A lead 113 references the voltage comparator 112 to the line 81.

As is known in the lamp art, failure of a lamp is characterized by an open filament thereof. Thus, failure of the main lamp 18 will provide an open circuit to the current sensing means 95 resulting in no main lamp current therethrough. Cessation of current through the current sensing means 95 causes that portion of the voltage source dropped thereacross to vanish, resulting in no alternating-current voltage for the rectification means 97 to rectify. Thus, the first voltage reference 100 collapses. The second voltage reference 104 is then able to directly influence the tracking voltage appearing at the lead 111, causing said tracking voltage reference to change in potential with respect to the line 81. The change in potential between the lead 111 and the line 81 cause the voltage comparator 112 to change in output on a lead 115 thereby causing an electronic switch means 116 to also change its conduction state. Change in conduction state of the electronic switch means 116 on a lead 117 causes an electromechanical means 118 to change in energization state. The electromechanical means 118 is mechanically coupled, as indicated at 120, to the switch 53 and to a second switch **53*a*. The second switch 53*a* is physically a part of the switch 53 and the operation and significance thereof are hereinafter described. Change in energization of the electromechanical means 118 causes the switch 53 to change from the position illustrated in FIG. 2 to electrically connect the terminal 93 with the contact 91 thereby energizing the spare lamp 19. The electromechanical means 118 is referenced to the input line 82 by a lead 119**.

The turn-on delay 105 is interposed between the second voltage reference 104 and the voltage summing and dividing means 109 to allow potential from the first voltage reference 100 on the lead 108 to rise faster than the potential from the second voltage reference 104 on the lead 110 when power is first spplied to the circuit 80. The difference in potential rise times on the leads 108, 110 keeps the tracking voltage reference on the lead 111 near the potential on the input line 81 to avoid having the voltage comparator 112 inadvertently detect the difference between the tracking voltage reference on the lead 112 and the potential on the input line 81 as indicative of the failure of the main lamp 18 when the voltage source is first applied to the circuit 80 by closing the power switch 83. It will be readily appreciated by those skilled in the art that the need for any turn-on delay 105, and whether such delay 105 is required with respect to the second voltage reference 104 or the first voltage reference 100, depends upon the characteristics of the voltage comparator 112 and the respective rise times of the first voltage reference 100 and the second voltage reference 104. Because the control circuit 80 is operated directly from an alternating-current voltage source and it is generally not known whether input line 81 will be positive or negative with respect to input line 82 at the instant in which power is first applied to the circuit 80, it is possible that some delay will have to be associated with one of the voltage references 100, 104 to avoid a turn-on hazard in the voltage comparator 112.

After the main lamp 18 has failed and the circuit 80 has caused the switch 53 to close against the contact 91 thereby energizing the spare lamp 19, current through the current sensing means 95 will cause the circuit 80 to again assume a monitoring mode wherein the electromechanical means 118 assumes the prior energization state. From an energy consumption standpoint, it is preferable to have the electromechanical means 118 de-energized while the circuit 80 is in a monitoring mode and to have the electromechanical means 118 energized for the brief instant after which the main lamp 18 has failed but the switch 53 has not yet changed position from the contact 90 to the contact 91. However since circuit 80 has completed its function when it has caused the switch 53 to change positions such that the spare lamp 19 is energized, further energy consumption considerations make it preferable to interrupt the functioning of the circuit 80. For this purpose, the switch 53 preferably has another pair of contacts 121, 122 with the contact 121 in series with the circuit 80 between the input lines 81, 82. These separate contacts 121, 122 comprise the second switch **53*a*. The switch 53*a* is normally closed against the contact 121 to allow operation of the circuit 80. When the main lamp 18 fails and the circuit 80 causes the switch 53 to change position in response to the electromechanical means 118 as previously described, the switch 53*a* opens against the contact 122 thereby interrupting and rendering inoperative the control circuit 80. Thus, further energy consumption in, and biasing of, the circuit 80** are avoided.

Turning now to FIG. 3, the current sensing resistor 96 drops several volts of alternating-current voltage thereacross during operation of the main lamp 18. A rectifying diode 124 has an anode terminal connected through the lead 98 and the lead 94 to one terminal of the current sensing resistor 96. The cathode terminal of the diode 124 is connected through the lead 99 to the terminal 125. A capacitor 126 is connected between the junction 125 and the line 81 on the other side of the resistor 96. The diode 124 half-wave rectifies the alternating-current voltage appearing across the resistor 96 during that portion of the cycle in which the lead 94 is positive with respect to the line 81, in a peak-charging manner. A first voltage reference is thereby established across the capacitor 126.

A second rectifying diode 128 has a cathode terminal referenced to the input line 82 by lead 102 through the switch **53*a*. The anode terminal of the diode 128 is connected by lead 103 to a junction 129. A capacitor 130 is connected between the input line 81 and the junction 129. The diode 128 half-wave rectifies the voltage source between the input lines 81, 82 to establish a second voltage reference across the capacitor 130, in a peak-charging manner. It will be appreciated that because of the manner in which the diodes 124, 128 are poled, the second voltage reference across the capacitor 130 is of opposite polarity to the first voltage reference across capacitor 126. Both capacitors 126, 130 are referenced to the input line 81**.

Also connected to the junction 129 is a resistor 131 with the other terminal thereof connected to another junction 132. A capacitor 133 is connected between the junction 132 and the input line 81. The values of the resistor 131 and the capcitor 133 are selected to provide a relatively large resistive-capacitive time-constant with respect to the operating frequency of the voltage source. Thus, when the voltage source is first applied to the circuit 80 by closing the power switch 83 the potential at the junction at 132 with respect to the line 81 will rise considerably slower than the potential at the junction 129.

A resistor 135 is connected between the junction 125 and another junction 136. Another resistor 137 is connected between the junction 136 and the junction 132. The resistors 135, 137 serve to sum and proportion the first voltage reference appearing at terminal 125 and the delayed second voltage reference appearing at the terminal 132 to thereby provide a tracking voltage reference at the junction 136, and at the lead 111 connected to the junction 136.

A transistor 139 has a base terminal thereof connected by the lead 111 to the junction 136 and an emitter terminal thereof connected through the lead 113 to the input line 81. Transistor 139 is of the PNP type. The tracking voltage reference established by the voltage summing and dividing resistors 135, 137 on the lead 111 will keep the transistor 139 in a non-conductive state if the tracking voltage reference is approximately equal to the potential appearing at the line 81. However, it is preferable to select the values of the voltage summing and dividing resistors 135, 137 such that the tracking voltage reference on the lead 111 is a couple volts positive with respect to potential appearing on the line 81 to avoid the transistor 139 from being rendered conductive because of electrical noise in the circuit 80.

When the main lamp 18 fails and current ceases to flow in the current sensing resistor 96, no voltage drop will appear across the current sensing resistor 96 and the diode 124 will no longer peak-charge the capacitor 126. Thus, the first voltage reference appearing at the junction 125 will begin to drop below the potential of line 81 as the capacitor 126 discharges through the resistors 135, 137, 131. As this discharge of capacitor 136 continues, a point in time will be reached at which the emmitter-base junction of the transistor 139 becomes forward biased. At this time, the transistor 139 is rendered conductive. Thus, the emitter-base junction of the transistor 139 behaves as a voltage comparator in comparing the tracking voltage reference on the line 111 to the potential on the input line 81.

A collector terminal of the transistor 139 is connected by lead 117 to an elcetromechanical device 35, with said device having a movable plunger 36 mechanically adapted to change the position of switch 53 and the switch **53*a*. Another terminal of the device 35 is connected by a lead to a resistor 141. The other terminal of the resistor 141 is connected to an anode terminal of a diode 142, with a cathode terminal thereof connected to the lead 102 at a junction 143. Another diode 144 is connected between the leads 117, 119, in parallel with the electromechanical device 35. The diode 144 is poled such that a cathode terminal thereof is connected to the collector terminal of the transistor 139 and to the lead 117, with the anode terminal thereof connected to the lead 119 and the resistor 141. The diode 142 is poled such that an anode terminal thereof is connected to the resistor 141 and the cathode terminal thereof is connected to the junction 143. The diode 142 serves to prevent conduction of the transistor 139 during those portions of the alternating-current cycle in which the line 82 is positive with respect to the line 81 and also serves to prevent reverse voltage breakdown of the transistor 139 during said portions of the alternating-current cycle. Besides functioning as a voltage comparator, the transistor 139 behaves as an electronic switch in applying the voltage source across the lines 81, 82 to the electromechanical device 35, the resistor 141 and the diode 142. It will be readily appreciated by those skilled in the art however that the transistor 139 could behave as a voltage comparator alone with the collector terminal thereof driving a separate semiconductor (not shown) or switch means (not shown), with the separate semiconductor or switch means controlling energization of the electromechanical device 35**.

When transistor 139 is rendered conductive, the electromechanical device 35 is energized causing the plunger 36 to move and the switch 53 to change position from the contact 90 to the contact 91. During energization of the device 35, the resistor 141 limits the maximum current which can pass through the windings of the device 35 to a suitable level. The diode 144 is normally non-functioning or is reverse biased. When the transistor 139 again returns to its non-conductive state, the diode 144 provides an inductive current path for the device 35 as the device 35 de-energizes. The diode 144 limits the negative voltage across the device 35 to a forward-biased diode drop and thereby avoids having the device 35 place a large negative inductive voltage spike on the collector terminal of the transistor 139.

When the transistor 139 energized the electromechanical device 35, switch **53*a* was caused to move from contact 121 to contact 122 to open the switch 53*a*, thereby de-energizing the electrochemical device 35. The device 35 is energized only for the brief interval necessary to change position in switches 53, 53*a*. Opening of the switch 53*a* also interrupts normal biasing of the circuit 80 and further avoids placement of a large negative voltage on the capacitor 126. The capacitor 126 is preferably of an electrolytic, polarized type which cannot withstand large negative voltages thereacross. Normal biasing current for the circuit 80** is in the range of a couple milliamperes.

All of the electrical circuit elements within the dashed line **29*a* in FIG. 3 are suitable for mounting upon the circuit board 29 in FIG. 1**.

Typical component values and ratings for the various circuit elements in FIG. 3, with the circuit 80 operating from a 120 volt source, as follows;

| | |
|---|---|
| Diode 124 | 1N4002 |
| Diode 128 | 1N4006 |
| Diode 142 | 1N4006 |
| Diode 144 | 1N4006 |
| Capacitor 126 | 25 micro-farads, 15 volts |
| Capacitor 130 | 1 micro-farad, 200 volts |
| Capacitor 133 | 5 micro-farads, 150 volts |
| Resistor 96 | 5 ohms, 30 watts, wire-wound |
| Resistor 131 | 47 kilo-ohms |
| Resistor 137 | 22 kilo-ohms |
| Resistor 135 | 3.9 kilo-ohms |
| Transistor 139 | 2N5416 |
| Electromechanical device 35 | Solenoid, 24 volts drop-out, intermittent duty, 81 ohms |
| Lamps 18, 19 | Type ELH |

As previously discussed, light projection systems used in commercial applications are frequently operated at less than nominal voltages, especially when used in fading and dissolving modes of operation. It is therefore extremely important that any means of detecting failure of the main lamp 18 be capable of distinguishing between operation of the circuit 80 at reduced voltage source levels and between failure of the main lamp 18. The control circuit 80 is capable of performing this function. As the voltage source appearing across the input lines 81, 82 is decreased, less current passes through the main lamp 18 and through the current sensing resistor 96 such that the portion of the voltage source dropped across the current sensing resistor 96 also decreases. This further causes a corresponding decrease in the level of the first voltage reference appearing across the capacitor 126 because the diode 124 has a lower level of alternating-current voltage to half-wave rectify. Similarily, the second voltage reference appearing across the capacitor 130 decreases in potential in direct correspondence to the decrease in the voltage source appearing across the lines 81, 82. Because the tracking voltage reference appearing at lead 111 is obtained by summing and dividing the first and second voltage references, any decrease in the first and second voltage references proportionally affects the potential of the tracking voltage reference. Thus, proper selection of the resistors at the lead 111 to track any voltage variation in the potential of the voltage source across the input lines 81, 82. As further previously discussed, failure of the main lamp 18 causes collapse of the first voltage reference appearing across the capacitor 126 because the capacitor 126 discharges through the resistors 135, 137, 131 when a portion of the voltage source dropped across the current sensing resistor 96 is interrupted by failure of the main lamp 18. Thus the circuit 80 is capable of distinguishing between operation of the main lamp 18 at reduced voltage source levels and between failure of the main lamp 18.

It will be understood that various changes and modifications may be made without departing from the spirit of the invention as defined in the following claims, and equivalents thereof.

I claim:

1. A lamp system for a projector, said projector having a frame and at least one projection lens with an optical axis associated therewith, said system comprising:

a main lamp with a highly directional light pattern fixedly mounted in relationship to said frame, said lamp and the light pattern thereof aligned with the optical axis of said projection lens;

a spare lamp with a highly directional light pattern fixedly mounted in relationship to said frame, at a location not in alignment with the optical axis of said projection lens;

sensing means for detecting the failure of said main lamp, and for automatically energizing said spare lamp upon failure of said main lamp; and low mass reflecting means positionable between a first position whereat said reflecting means does not obstruct nor effect light transmission between said main lamp and said projection lens before failure of said main lamp, and a second position whereat said reflecting means reflects light from the automatically energized spare lamp along the optical axis of said projection lens.

2. The lamp system of claim 1 further comprising releasable securing means for holding said reflecting means in said first position before failure of said main lamp; and actuating means for releasing said securing means upon failure of said main lamp thereby permitting said reflecting means to assume said second position thereof.

3. The lamp system of claim 2 wherein said actuating means comprises an electromechanical device, with a movable plunger, said plunger capable of movement in response to an energized condition of said electromechanical device, said plunger is connected to said releasable securing means, and said electromechanical device is energized by said sensing means upon failure of said main lamp.

4. The lamp system of claim 1 wherein said reflecting means is pivotally connected in relationship to said frame thereby allowing said reflecting means to pivot between said first and second positions thereof.

5. The lamp system of claim 4 further comprising releasable securing means for holding said reflecting means in said first position before failure of said main lamp; actuating means for releasing said securing means upon failure of said main lamp thereby permitting said reflecting means to assume said second position thereof; and resilient means for urging said reflecting means from said first position to said second position.

6. The lamp system of claim 5 further comprising stop means with a shock absorbing portion to limit the pivoting movement of said reflecting means when said reflecting means has assumed said second position, with said resilient means continuing to urge said reflecting means against said stop means even when reflecting means assumes said second position, said stop means thereby providing an essentially vibration-free movement of said reflecting means between said first and second positions thereof.

7. The lamp system of claim 5 wherein said releasable securing means comprises a lever with a hooked end at one end thereof for holding said reflecting means in said first position; another end for connection to said actuation means; said lever being pivotable in relationship to said frame at a point intermediate said hooked end and said another end to release said reflecting means from said first position in response to said actuation means.

8. The lamp system of claim 1 wherein the light pattern of said spare lamp is at an oblique angle with respect to the optical axis of said projection lens.

9. The lamp system of claim 1 wherein said main lamp is mounted to and enclosed by a housing rigidly attached to frame of said projector, in a manner exterior to said projector, with a window area through said frame to permit light transmission between said main lamp and said projection lens.

10. The lamp system of claim 5 further comprising switch means for sensing the position of said reflecting means, said switch means having a pair of contacts electrically connected to said main lamp and to said spare lamp, said switch means electrically disconnecting said main lamp and electrically connecting said spare lamp to immediately begin energizing said spare lamp as said reflecting means leaves said first position thereof thereby allowing said spare lamp to energize as said reflecting means begins assuming said second position thereof for substantially uninterupted light upon failure of said main lamp.

* * * * *